US012577692B2

(12) United States Patent
Unru et al.

(10) Patent No.: US 12,577,692 B2
(45) Date of Patent: Mar. 17, 2026

(54) ELECTROLYSIS SYSTEM AND OPERATION METHOD THEREFOR

(71) Applicant: SMA Solar Technology AG, Niestetal (DE)

(72) Inventors: Alexander Unru, Baunatal (DE); Bernhard Voll, Lohfelden (DE); Heiko Stieber, Melbourne Beach, FL (US); Jens Keiser, Altena (DE); Luke Clark, Medical Lake, WA (US)

(73) Assignee: SMA Solar Technology AG, Niestetal (DE)

( * ) Notice: Subject to any disclaimer, the term of this patent is extended or adjusted under 35 U.S.C. 154(b) by 535 days.

(21) Appl. No.: 18/087,861

(22) Filed: Dec. 23, 2022

(65) Prior Publication Data

US 2024/0209533 A1 Jun. 27, 2024

(51) Int. Cl.
*C25B 15/02* (2021.01)
*C25B 1/04* (2021.01)
(Continued)

(52) U.S. Cl.
CPC ..... *C25B 9/65* (2021.01); *C25B 1/04* (2013.01); *C25B 15/02* (2013.01); *C25B 15/06* (2013.01)

(58) Field of Classification Search
None
See application file for complete search history.

(56) References Cited

U.S. PATENT DOCUMENTS

2021/0363651 A1* 11/2021 Seymour ..... H02M 7/219
2023/0050530 A1* 2/2023 Unru ..... H02M 1/0025
2023/0198247 A1 6/2023 Putz et al.

FOREIGN PATENT DOCUMENTS

CN 113388861 A 9/2021
EP 4074866 A1 10/2022
(Continued)

OTHER PUBLICATIONS

Machine translation of WO 2012/114915 A1 (Year: 2012).*

*Primary Examiner* — Harry D Wilkins, III
(74) *Attorney, Agent, or Firm* — Eschweiler & Potashnik, LLC

(57) ABSTRACT

An electrolysis system includes an electrolyzer and a conversion device for power supply of the electrolyzer out of a grid is disclosed. The electrolyzer includes a plurality of electrolysis cells connected in series to each other. The series connection of electrolysis cells is connected through a positive DC-line and through a negative DC-line to a DC-output of the conversion device. A conscious grounding of the series connection is provided via a grounding line at a connection point of the positive DC-line, at a connection point of the negative DC-line or at a connection point of an intermediate power line between two adjacent electrolysis cells. The electrolysis system has at least one overcurrent protection circuit that is arranged between two adjacent electrolysis cells of the series connection of electrolysis cells and connected in series with an intermediate power line connecting the two adjacent electrolysis cells of the series connection of electrolysis cells, and/or arranged in series with the grounding line between the connection point and ground (PE). If a ground fault is occurring at the series connection of electrolysis cells, one or more of the at least one overcurrent protection circuit is configured to trip and prevents an application of a damaging overcurrent and/or a damaging overvoltage to the electrolysis cells.

16 Claims, 5 Drawing Sheets

(51) Int. Cl.
*C25B 9/65* (2021.01)
*C25B 15/06* (2006.01)

(56) References Cited

FOREIGN PATENT DOCUMENTS

| | | | | | |
|---|---|---|---|---|---|
| WO | WO-2012114915 | A1 * | 8/2012 | ..... | C25B 9/70 |
| WO | WO-2021219367 | A1 * | 11/2021 | ..... | H02M 1/0025 |
| WO | 2022038146 | A1 | 2/2022 | | |

* cited by examiner

ELECTROLYSIS SYSTEM AND OPERATION METHOD THEREFOR

FIELD

The present disclosure relates to an electrolysis system and an operation method therefor. Particularly, the present disclosure relates to an electrolysis system and a corresponding operation method that provides a protection from damage during operation of an electrolysis system comprising a conscious grounding for its electrolyzer in case of an occurrence of an additional ground fault.

BACKGROUND

In recent years a rapidly growing demand for hydrogen is observed in many countries. One option to generate the increasing hydrogen demand in a climatic friendly way is given by a water electrolysis reaction, wherein water is decomposed into its chemical elements hydrogen $H_2$ and oxygen $O_2$ in an electrolyzer. The electrolyzer is supplied by a Direct Current (DC) electric power that drives the electrolysis reaction. The DC-electric power is converted and supplied to the electrolyzer by a conversion device arranged between the electrolyzer and a grid acting as a power source.

The hydrogen production rate typically increases with increasing DC-electric power. In order to reduce an electric current needed for the electrolysis reaction, the electrolyzer, in particular when it is used in an industrial application, comprises a plurality of electrolysis cells that are connected in series to each other. Although the required electrical current can be reduced, the series connection of electrolysis cells comprises a relatively large DC-voltage. For one or more reasons, e.g. an ageing protection for the electrolysis cells, electrical safety requirements etc., a conscious grounding is provided at the series connection of electrolysis cells. A conscious grounding at the series connection of electrolysis cells is a low impedance electrical connection between a particular point of the series connection of electrolysis cells and ground potential or earth potential. That low impedance connection is provided, in particular, intentionally provided, in order to define a reference potential for that particular point of the series connection of electrolysis cells. That particular point of the series connection can be arranged at the end of the series connection, e.g. at its positive or negative pole, or at an intermediate location within the series connection of electrolysis cells depending on the application. The conscious grounding or intentional grounding is different to an unintended grounding, that might occur at a point of the series connection of electrolysis cells, e.g. by an earth fault or ground fault at that point.

If now, in addition to the conscious grounding, a ground fault occurs at the series connection of electrolysis cells, this might lead to a short circuit of one or more electrolysis cells within the series connection of electrolysis cells. The series connection of electrolysis cells that was existing prior to the fault is now divided by the ground fault into two sub-strings or even three sub-strings, wherein each sub-string also comprises a plurality of electrolysis cells. Within these two or three sub-strings a first sub-string is arranged between the conscious grounding and the ground fault. For this first sub-string the respective electrolysis cells are suddenly short circuited. That sudden short-circuit in turn leads to a relatively large short circuit current in this first sub-string, which in turn might damage the electrolysis cells in this first sub-string. Each one of the electrolysis cells within the second sub-string and also, if existing within the third sub-string, are suddenly exposed to a relatively large DC voltage, because the DC voltage that was present prior to the ground fault is then suddenly applied to a series connection of electrolysis cells with a reduced effective number of electrolysis cells. This also might lead to a damage of the electrolysis cells within the second sub-string and, if existing, also the third sub-string. In addition, a further damage also might occur in the conversion device, since the conversion device has to supply the suddenly increased current, which potentially might exceed the maximum permitted current for that particular conversion device. Therefore, an optimized protection method for the electrolysis cells of the electrolyzer is desired, that eliminates or at least reduces one of the drawbacks mentioned above.

The printed document WO 2022/038146 A1 discloses a device for electrolysis from photovoltaically generated DC power, comprising an electrolyzer and a DC-to-DC converter. The DC-to-DC converter is designed to feed DC power to the electrolyzer via a DC bus. The DC power can be generated by a photovoltaic sub-generator that is connected to the DC-to-DC converter via a first disconnector. The first disconnector is coupled to an isolation monitoring means in such a way that closure of the first disconnector requires a successful check for sufficient isolation of the sub-generator. The sub-generator has a main string, wherein a second disconnector is arranged between the main string and the first disconnector. The second disconnector is coupled to a means for monitoring a fault current of the main string in such a way that the second disconnector is opened in the event that a predefinable limit value of the fault current is exceeded.

The printed document CN 113388861 A discloses an electrolytic bath system, a hydrogen production system, a hydrogen production power supply and an output-to-ground short-circuit detection circuit. In the output-to-ground short-circuit detection circuit, a first voltage dividing unit and a second voltage dividing unit are connected in series and then are connected in parallel with an electrolytic bath between the positive and negative electrodes of the output end of the hydrogen production power supply. A middle pole plate or a negative electrode of the electrolytic bath is grounded, and a connecting point of the two voltage dividing units is also grounded through a detection resistor. When a positive or a negative transmission loop between the hydrogen production power supply and the electrolytic bath has a short-circuit fault to the ground, the voltage at the connection point between the two voltage dividing units changes and is reflected through a short-circuit detection result generated at the connection point.

SUMMARY

An electrolysis system according to the present disclosure comprises an electrolyzer and a conversion device for power supply of the electrolyzer out of a grid.

The electrolyzer comprises a plurality of electrolysis cells connected in series to each other. The series connection of electrolysis cells is electrically connected with its first end through a positive DC-line and with its second end through a negative DC-line to a Direct Current-(DC-) output of the conversion device.

A conscious grounding of the series connection of electrolysis cells is provided at a connection point of the positive DC-line, at a connection point of the negative DC-line or at a connection point of an intermediate power line between two adjacent electrolysis cells. The electrolysis system further comprises at least one overcurrent protection circuit that is arranged between two adjacent electrolysis cells of the series connection of electrolysis cells and connected in series with an intermediate power line connecting the two adjacent electrolysis cells of the series connection of electrolysis cells, and/or is arranged in series with the grounding line between the connection point and ground (PE).

One or more of the at least one overcurrent protection circuit is/are configured to trip if a ground fault is occurring at the series connection of electrolysis cells in addition to the conscious grounding provided, such that an application of a damaging overcurrent and/or a damaging overvoltage to the electrolysis cells is prevented, or at least reduced.

A method according to the present disclosure is applicable to the electrolysis system according to the disclosure and comprises operating the electrolysis system in a normal-operating-mode (NOM), wherein a DC-power is supplied to the series connection of electrolysis cells by the conversion device, and in response to a ground fault occurring at the series connection of electrolysis cells in addition to the conscious grounding provided, initiating a tripping of one or more of the at least one overcurrent protection circuit and thereby operating the electrolysis system in a fault-operating-mode (FOM) during which a damaging overcurrent and/or overvoltage applied to one, more or each of the plurality of electrolysis cells is prevented.

By arranging the at least one overcurrent protection circuit as mentioned above, i.e. between two adjacent electrolysis cells of the series connection of electrolysis cells and in series connection to an intermediate power line connecting these two electrolysis cells and/or in series with the grounding line between the connection point and ground (PE), an effective protection of the electrolysis cells and also of the conversion device can be achieved. That is due to the following:

If a ground fault is occurring at the series connection of electrolysis cells in addition to the conscious grounding provided, the series connection again is divided by the ground fault and the conscious grounding provided into two sub-strings or even three sub-strings each having a series connection of a respective plurality of electrolysis cells. If the conscious grounding is provided at the positive DC line or at the negative DC line and the ground fault is occurring at an intermediate location within the series connection of electrolysis cells, that leads to the division of the series connection of electrolysis cells into two sub-strings. If the conscious grounding is provided within the series connection of electrolysis cells, i.e. between two adjacent electrolysis cells, and the ground fault also occurs within the series connection of electrolysis cells, that leads to the dividing of the series connection of electrolysis cells into three sub-strings. in other words, if there are two ground contacts at different intermediate locations within the series connection of electrolysis cells a division into three sub-strings results, wherein one of the resulting sub-strings is short circuited and two of the resulting sub-strings are exposed to an overvoltage generated by the DC-output of the conversion device. If there is only one ground contact at an intermediate location within the series connection of electrolysis cells and the other ground contact is located at the positive DC line or the negative DC line, a division into two sub-strings results, wherein one of the resulting sub-strings is short circuited and the other one of the resulting sub-strings is exposed to an overvoltage generated by the conversion device.

For the following explanation it is exemplarily and without limitation assumed that the first sub-string is the short circuited one, whereas the second sub-string—and, if existing also the third sub-string—is/are exposed to an overvoltage generated by the conversion device.

Since the first sub-string comprises a series connection of a plurality of electrolysis cells, the voltage built up by that series connection of electrolysis cells is suddenly reduced to nearly 0V with the occurrence of the ground fault. Thus, each of the electrolysis cells within the first sub-string is suddenly discharged by a large discharge current that might damage the respective electrolysis cells. That discharge current is driven by the voltage that previously was formed by the series connection of the electrolysis cells within the first sub-string and also occurs, if the positive DC line and also the negative DC line are interrupted, and thus the electrolysis cells are isolated from the conversion device, e.g. via respective circuit breakers in these DC lines. In the method and the electrolysis system according to the disclosure, however, provided that one or more overcurrent protection circuits of the at least one overcurrent protection circuit is/are each arranged in series with an intermediate power line in that first sub-string that discharge current also flows through the/these respective overcurrent protection circuit(s) of the at least one overcurrent protection circuit and thus leads to its/their tripping. As a result, the discharge current in the short circuited first sub-string is interrupted or at least reduced down to a harmless current level, at which a damaging effect on the electrolysis cells within that first sub-string is prevented. A damaging effect on the second sub-string—and if existing also the third sub-string—can then be prevented by an overcurrent protection circuit that is arranged in the positive DC line and/or in the negative DC line. Alternatively or cumulatively, it is possible to prevent or at least reduce that overvoltage situation and its damaging effect on the respective second and third sub-strings by a power flow that is directed from the electrolyzer to the grid that is driven by the conversion device. In this case the power flow reduces the voltage on the DC output of the conversion device.

In the above explanation it was assumed that the one or more overcurrent protection circuits of the at least one overcurrent protection circuit are each arranged in series with an intermediate power line connecting two adjacent electrolysis cells within the first sub-string. However, a similar situation also takes place, in case the at least one overcurrent protection circuit is not arranged in series with an intermediate power line but in series with the grounding line between the connection point and ground. In this case the discharge current within the short circuited first sub-string is flowing over the conscious grounding and thus also over the at least one overcurrent protection arranged in the grounding line. Thus, also in this case a tripping of the overcurrent protection circuit arranged in the grounding line is initiated and the discharge current within the first sub-string is interrupted.

In one embodiment of the electrolysis system, the grid is formed by a DC grid and the conversion device is configured as a DC/DC-converter. In an alternative embodiment of the electrolysis system the grid is an AC grid and the conversion device arranged between the electrolyzer and the grid is configured as an AC/DC-converter. In the latter case, the AC/DC-converter in one embodiment can be configured as a single stage conversion device comprising an AC/DC-conversion circuit or unit. In case the grid is formed as an AC-grid it is alternatively also possible that the conversion device is configured as a multi-stage converter comprising an AC/DC-conversion unit and a DC/DC-conversion circuit or unit. Independent of the type of the grid and independent of whether the conversion device is configured as an AC/DC-converter or a DC/DC-converter, the conversion device, in one embodiment, can be formed as a bidirectional conversion device. The bidirectional conversion device is configured to provide a power flow and its associated conversion in both directions, i.e. from the grid to the electrolyzer and vice versa. Therefore, with the bidirectional conversion device it is possible to not only supply electrical power from the grid to the electrolyzer during a normal operation mode (NOM) of the electrolysis system, but also to transfer a charge that is built-up in the series connection of the electrolysis cells of the electrolyzer by a respective power flow into the grid. Via that power flow, that is in opposite direction to the power flow in normal operating mode (NOM), it is possible to decrease a voltage on the DC-output by transferring an electric power from the DC-output to the grid, e.g. during the fault-operating-mode (FOM) and/or even during the transfer to the fault-operating-mode (FOM). Therefore, in one embodiment, the electrolysis system comprises a control device that is configured to control the conversion device in the fault-operating-mode (FOM) or during the transfer to the fault-operating-mode (FOM) to stop power conversion or to reduce the DC-voltage at the DC-output to a harmless voltage value or below. The harmless voltage value can be chosen such, that on one side an overvoltage of each electrolysis cell within the series connection of electrolysis cells is prevented. This can be achieved by a voltage value at the DC-output that leads to a current value through the conversion device, that is equal to the current in the normal operating mode NOM prior to the occurrence of the ground fault. Alternatively or cumulatively, it is also possible to choose a voltage value that leads to a stop or a pause of the electrolysis reaction in the electrolysis cells, which then is defined by a current value of OA or at least nearly OA. It is also possible to choose a voltage value such that an injury of a person touching that voltage is securely prevented, which then might lead to a voltage value of approximately 60 V, for example. It is, however, also possible to choose a voltage value at the DC-output of 0V or at least approximately 0V. In this manner, an overvoltage situation and a damaging effect on the second sub-string—and, if existing, on the third sub-string—can effectively be prevented.

The fault-operating-mode or the transfer to the fault-operating-mode in one embodiment can be signaled to the control circuit by the at least one overcurrent protection circuit. Here, the at least one overcurrent protection circuit is configured, in one embodiment, immediately prior to its tripping or in response to its tripping to provide a signal to a control circuit of the electrolysis system signaling the fault-operating-mode or the transfer to the fault-operating-mode. This, in particular, can be the case for an overcurrent protection circuit comprising a control connection to the control circuit of the electrolysis system, e.g. for an electronic fuse. Alternatively or cumulatively, it is also possible, that the fault-operating-mode or the transfer to the fault-operating-mode is signaled to the control circuit by current and voltage values, that are present at the DC-output of the conversion device, wherein the current and voltage values deviate, or at least deviate more than a predefined tolerance, from a current-voltage (IU) characteristic-curve of the electrolyzer. It is also possible that the transfer to the fault-operating-mode or the fault-operating-mode is signaled to the control circuit of the electrolysis system by voltage measurements conducted at multiple intermediate power lines connecting adjacent electrolysis cells of the series connection. This is explained in more detail in combination with the fault localization means of FIG. 4*a* or FIG. 4*b*.

The expression "during the fault-operating-mode (FOM)" refers to a state of the electrolysis system, during which one or more of the at least one overcurrent protection circuit has been tripped. In contrast thereto, the expression "during the transfer to the fault-operating-mode (FOM)" refers to a state of the electrolysis system prior to the tripping of one or more of the at least one overcurrent protection circuit. In one embodiment, the transfer can cover a period starting from the detection of the ground fault (e.g. its occurrence and optionally in addition also its location) up to the point in time, where the one or more of the at least one overcurrent protection circuit has been tripped.

The reduction of the voltage at the DC output reduces the overvoltage of the electrolysis cells within the second sub-string and the third sub-string and therefore the driving force of a damaging overcurrent therethrough. Alternatively or cumulatively thereto, it is also possible to interrupt a damaging overcurrent, that might be caused by the sudden overvoltage via one or two further overcurrent protection circuits arranged in series to a DC power line between the DC output and the electrolyzer. Therefore, in one embodiment of the electrolysis system in addition to the at least one overcurrent protection circuit in series with an intermediate power line connecting two adjacent electrolysis cells and/or in series with the grounding line between the connection point and ground, a further overcurrent protection circuit is located in series to the positive DC-line or in series to the negative DC line. In a further embodiment, two further overcurrent protection circuits, each arranged between the DC-output and the electrolyzer, are provided, wherein one of the two further overcurrent protection circuits is located in series to the negative DC line and the other one is located in series to the positive DC line.

Dependent on the size of the electrolyzer, in particular the capacitance and/or the number of its electrolysis cells, it may be desired that—in reaction to a detected ground fault—the total end-to-end voltage of the series connection of electrolysis cells of the electrolyzer is divided into more than only two sub-strings, e.g. three or even more sub-strings. With an increasing number of isolated sub-strings after the division an end-to-end voltage of each isolated sub-string can be limited to a reduced voltage value. Thus, in these cases a single overcurrent protection circuit arranged in an intermediate power line between two adjacent electrolysis cells within the series connection of electrolysis cells may not be enough. Therefore, in one embodiment of the electrolysis system the at least one overcurrent protection circuit comprises two or more overcurrent protection circuits that are each arranged at a different intermediate location within the series connection of electrolysis cells and that are each connected in series with an intermediate power line connecting two adjacent electrolysis cells of the series connection of electrolysis cells.

In some electrolyzers the plurality of electrolysis cells comprises multiple electrolysis stacks, wherein each electrolysis stack contains a series connection of multiple electrolysis cells. These multiple electrolysis stacks are then connected in series to each other in order to built-up the total series connection of electrolysis cells of the electrolyzer. An electrolysis stack therefore is an assembly component of the electrolyzer that typically comprises a lower number of electrolysis cells connected in series to each other than this is the case for the total series connection of the electrolysis cells of the electrolyzer. When assembling the electrolyzer out of multiple standardized electrolysis stacks each one of the at least one overcurrent protection circuit can easily be provided between two adjacent electrolysis stacks. Therefore In one embodiment of the electrolysis system the plurality of electrolysis cells is formed by a plurality of electrolysis stacks connected in series to each other, wherein each electrolysis stack comprises a group of multiple electrolysis cells connected in series to each other, and wherein the at least one overcurrent protection circuit comprises a plurality of overcurrent protection circuits, wherein each overcurrent protection circuit of the plurality of overcurrent protection circuits is arranged between two adjacent electrolysis stacks.

The at least one overcurrent protection circuit can be realized by different options. According to one embodiment of the electrolysis system one or more of the at least one overcurrent protection circuit can be formed as a melt-fuse. A melt fuse is an inexpensive component. However, after its tripping the tripped melt-fuse has to be substituted with a new un-tripped one, which might cause some change effort. Alternatively or cumulatively, one or more overcurrent protection circuits of the at least one over current protection circuit can be formed as an electronic fuse. An electronic fuse typically comprises a current sensor and a switch, e.g. an electromechanical switch, a semiconductor switch or a combination of both, that is controlled based on a current measured by the current sensor, such that if the measured current exceeds a current threshold value ITH, the measured current is interpreted as an overcurrent and the switch, that actually is closed in order to provide a low impedance current path, is opened in order to interrupt the overcurrent. Regarding the component price an electronic-fuse typically is more expensive than a melt-fuse. However, it does not need to be substituted after its tripping. Moreover, since the tripping operation is realized by a controlled switching operation, the same electronic-fuse can be used for multiple tripping operations and an effort for its substitution can be spared. Independent of whether the overcurrent protection circuit is formed by a melt fuse or an electronic fuse, it can comprise a current limiting circuitry that is configured to provide a controlled discharge operation for charged electrolysis cells during the transfer to the fault operating or during the fault-operating-mode of the electrolysis system.

If a ground fault is detected in the electrolysis system it is desired to stop power flow that is directed from the grid into the ground fault, since otherwise that power flow might cause a damage to the electrolysis cells and/or the conversion device. Therefore, in one embodiment, the method comprises the act that in response to a transfer to the fault-operating-mode and/or during the fault-operating-mode of the electrolysis system, a control circuit of the electrolysis system controls the conversion device to stop its power conversion. By stopping the power conversion, e.g. by deactivating the conversion device, the power flow through the conversion device is interrupted in each direction, i.e. in direction to the grid as well as in direction from the grid. Here, only a residual charge present in a capacitor associated with the DC output of the conversion device might cause a small decreasing power flow in the direction toward the series connection of electrolysis cells. Thereby, the capacitor associated with the DC-output is discharged and a DC-output-voltage of the conversion device is reduced. Here, the capacitor is passively discharged, wherein a recharging from the grid is prevented by the deactivated conversion device. In an alternative embodiment, the electrolysis system comprises a bidirectional conversion device and the control circuit of the electrolysis system controls the conversion device to generate power flow that is directed from its DC-output to the grid. Here, the capacitor associated with the DC-output is actively discharged by a power flow that is fed to the grid and that is driven by the conversion device, e.g. the AC/DC conversion circuit or a DC/DC conversion circuit of the conversion device. Independent of weather the capacitor is passively discharged or actively discharged, the DC-output-voltage of the conversion device is reduced, a damaging effect by an excess voltage for the electrolysis cells within the second sub-string—and if existing the third sub-string—can be prevented. This in particular is relevant, if a tripped one of the at least one overcurrent protection circuit is arranged in series to the intermediate power line connecting adjacent electrolysis cells of the series connection of electrolysis cells.

In an alternative embodiment, the tripped one of the at least one overcurrent protection circuit is arranged in series to the grounding line between the connection point and ground. In this case although, it is possible, it is not necessary to stop an electrolysis reaction and therefore a power supply of the electrolysis system during the fault-operating-mode of the electrolysis system. Moreover, in this case the control circuit controls the conversion device to at least temporarily continue its power supply to the electrolyzer, in particular to the series connection of its electrolysis cells, such that e.g. a hydrogen production that is driven by the electrolyzer does not need to be interrupted, at least does not need to be interrupted for a longer period. This is due to the following: during the normal operation mode of the electrolysis system only the conscious grounding of the series connection of electrolysis cells is present. When the ground fault occurs, for a short period there are two ground connections applied to the series connection of electrolysis cells, typically at different locations within the series connection. The two ground connections at different locations are mainly causing the damaging effect to the electrolysis cells (i.e. an overvoltage and/or an overcurrent). However, after the tripping of the overcurrent protection, that is arranged in series with the grounding line between the connection point and ground, again there is only one grounding connection applied to the series connection of electrolysis cells, which grounding connection now is formed by the ground fault.

Independent of whether or not an electrolysis reaction needs to be interrupted due to a ground fault, it can be advantageous, that an operator, an owner or a respective service personal of the electrolysis system is informed about an initiated fault-operating-mode of the electrolysis system. Thus, in one embodiment of the method, in response to the transfer to the fault-operating-mode or during the fault-operating-mode, a signal is generated by the electrolysis system indicating its fault-operating-mode and/or an information about the one or more of the at least one overcurrent protection circuit that has/have been tripped. Thus, the service personal is informed about the incident and necessary preparations for repairing the electrolysis system can be taken prior to an appearing on site of the electrolysis system.

In particular for large electrolyzers comprising a larger number of electrolysis cells—and thus also a larger number of overcurrent protection circuits—it is advantageous to know, which one (or which ones) of the at least one overcurrent protection circuit has/have been tripped and/or where at which location within the series connection of electrolysis cells the ground fault has occurred. With this information an on-site effort needed for repairing the electrolysis system can be reduced/minimized. An option and an apparatus for localizing the ground fault is based on a measurement of multiple voltages that are associated with different intermediate power lines and in each case ground potential. Therefore, in order to localize the ground fault, in one embodiment of the method the electrolysis system comprises a fault localization circuit, wherein multiple voltages, each between an intermediate power line connecting two adjacent electrolysis cells and ground, are measured for a plurality of different intermediate power lines of the series connection of electrolysis cells. Alternatively or cumulatively, it is also possible that, instead of a voltage measurement between an intermediate power line and ground, one or more of the voltages are measured between different intermediate power lines or between an outer intermediate power line and the positive DC-line or between an outer intermediate power line and the negative DC-line. The voltage measurements can take place during the normal-operating-mode, during the transfer to the fault-operating-mode and/or during the fault-operating-mode.

BRIEF DESCRIPTION OF THE DRAWINGS

In the following, the disclosure is further explained and described with respect to example embodiments illustrated in the drawings.

DETAILED DESCRIPTION

Figure 1:
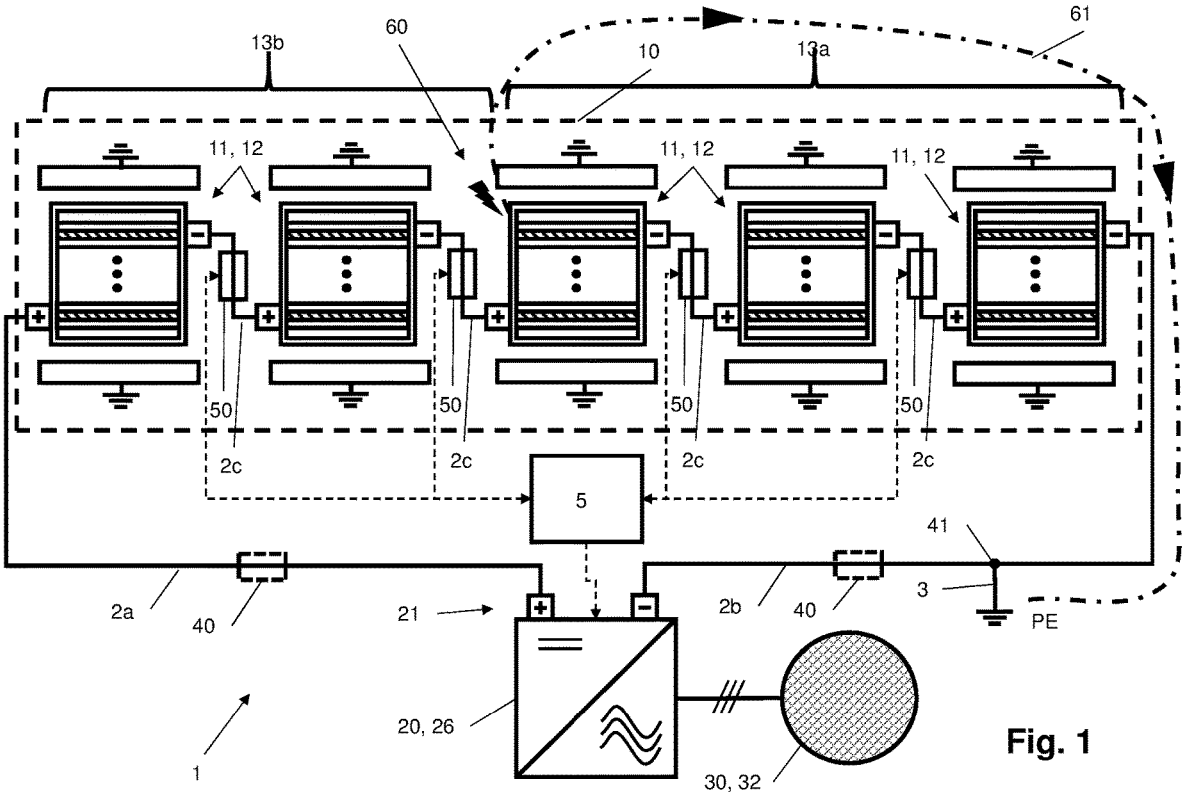
FIG. 1 illustrates a first embodiment of an electrolysis system according to the present disclosure.

FIG. 1 illustrates an electrolysis system 1 according to the present disclosure in a first embodiment. The electrolysis system 1 comprises an electrolyzer 10, a conversion device 20 and a control unit 5 controlling the conversion device 20. The conversion device 20 is formed as an AC/DC-converter 26 that, on its AC-side is connected to an AC-grid 32 as grid 30. A DC output 21 is connected via a positive DC line 2*a* and a negative DC line 2*b* to a DC input of the electrolyzer 10. In one embodiment, the electrolyzer 10 comprises a series connection of multiple (here exemplarily: five) electrolysis stacks 12, that are connected to each other by intermediate power lines 2*c*. Each electrolysis stack 12 itself comprises a plurality of electrolysis cells 11 connected in series to each other. The electrolyzer 10 further comprises multiple (here exemplarily: four) overcurrent protection circuits 50 each arranged between two adjacent electrolysis stacks 12 and connected in series to a respective intermediate power line 2*c*. In series with the positive DC-line 2*a* and in series with the negative DC-line 2*b* the electrolysis system comprises two further overcurrent protection circuits 40, a respective one in each of the DC-lines 2*a*, 2*b*.

During a normal-operation-mode (NOM) of the electrolysis system 1 the control unit 5 controls the conversion device 20 to convert an AC power delivered from the AC grid 32 into a DC power that is supplied to the electrolyzer 10 for performing the electrolysis reaction. If a ground fault 60 occurs (here exemplarily sketched at the third electrolysis stack 12) the series connection of electrolysis stacks 12, and thus also the series connection of electrolysis cells 11, is divided by the ground fault 60 into a first sub-string 13*a* and a second sub-string 13*b*. The series connection of the electrolysis cells 11 within the first sub-string 13*a*, and thus each respective electrolysis cell therein, is short-circuited via the ground fault 60 and the conscious ground PE provided at the negative DC line 2*b*. That short-circuit leads to a discharge of the electrolysis cells 11 within that first sub-string 13*a* along a current path 61 that has been generated by the ground fault 60. In addition thereto, the series connection of electrolysis cells 11 within the second sub-string 13*b*, and thus each respective electrolysis cell in the second sub-string 13*b*, is exposed to an overvoltage. This is due to the fact that the total voltage at the DC output 21 of the conversion device 26, that previously was applied to the DC-input of the electrolyzer (here: applied to 5 electrolysis stacks 12 connected in series) after the ground fault 60 is applied to a smaller number of electrolysis stacks 12 connected in series (here: two electrolysis stacks 12).

The discharge of electrolysis cells 11 in the first sub-string 13*a* leads to fault current across the current path 61 and the intermediate power lines 2*c* arranged between two adjacent electrolysis stacks 12 in that first sub-string 13*a*. That fault current is decoupled from and cannot be controlled by the conversion device 26. In a conventional electrolysis system, that fault-current therefore typically leads to a damage of the respective electrolysis cells 11 in the first sub-string 13*a*. In the electrolysis system 1 in FIG. 1, however, that fault-current also has to pass the overcurrent protection circuits 50 connected in series with the intermediate power lines 2*c* in the first sub-string 13*a* and thus results in a tripping of at least one, optionally also more, thereof. Thus, the fault current is interrupted and a damaging effect to the respective electrolysis cells 11 within the first sub-string 13*a* is prevented.

The overvoltage applied to the electrolysis cells 11 within the second sub-string 13*b* leads to an increasing current to the electrolyzer, and consequently also an increasing electrolysis reaction, therein. The increasing current is supplied by the conversion device 20 via the positive DC-line 2*a* and the intermediate power lines 2*c* within the second sub-string 13*b*. Thus, the increasing current also has to pass the overcurrent protection circuits 50 associated with the intermediate power lines 2*c* within the second sub-string 13*b*, and if present, also the further overcurrent protection 40 in the positive DC-line 2*a*. As a result, one or more of these overcurrent protection circuits 50 and the optionally provided further overcurrent protection 40 is tripped and the current in the second sub-string 13*b* is also interrupted.

The increasing fault current and/or the tripping of the overcurrent protection circuits 50 can be communicated, e.g. via the control lines illustrated in dashed lines, or otherwise signaled to the control circuit 5. Therefore, the control circuit 5 is aware of the fault-operating-mode and/or the transfer to the fault-operating-mode. In addition, the increasing current within the second sub-string 13*b* is typically also detected by the conversion device 20 or detected by the control circuit 5 controlling that conversion device 20. Thereby in addition, a transfer to the fault-operating-mode (FOM) or an operation of the electrolysis system 1 in the fault-operating-mode FOM can be signaled to the control circuit 5.

In case the conversion device 20 is a bidirectional one, it is also possible, that during the transfer to the fault-operating-mode FOM or in the fault-operating-mode FOM of the electrolysis system 1 the control circuit 5 controls the conversion device to reduce a voltage present at the DC-output 21, e.g. by a reverse power flow from the DC-output 21 to the grid 30, here: the AC-grid 32. In such an embodiment, a damaging effect of the overvoltage and the overcurrent to the electrolysis cells 11 in the second sub-string 13*b* can be avoided, eventually also without a tripping of the respective overcurrent protection circuits 50, 40.

In FIG. 1 the overcurrent protection circuits 50 are each exemplarily illustrated as a melt fuse. However, it is also possible that one, more or each of the overcurrent protection circuits 50 is/are formed by an electronic fuse. In FIG. 1 the conscious grounding of the electrolysis system 1 is exemplarily provided at a connection point 41 at the negative DC line 2*b* a grounding line 3 between the connection point 41 and ground PE. However, in one embodiment, another location of the conscious grounding is also possible e.g. at the positive DC-line 2*b* or at one of the intermediate power lines 2*c* connecting two adjacent electrolysis cells 11 within the series connection of electrolysis cells 11.

Figure 2:
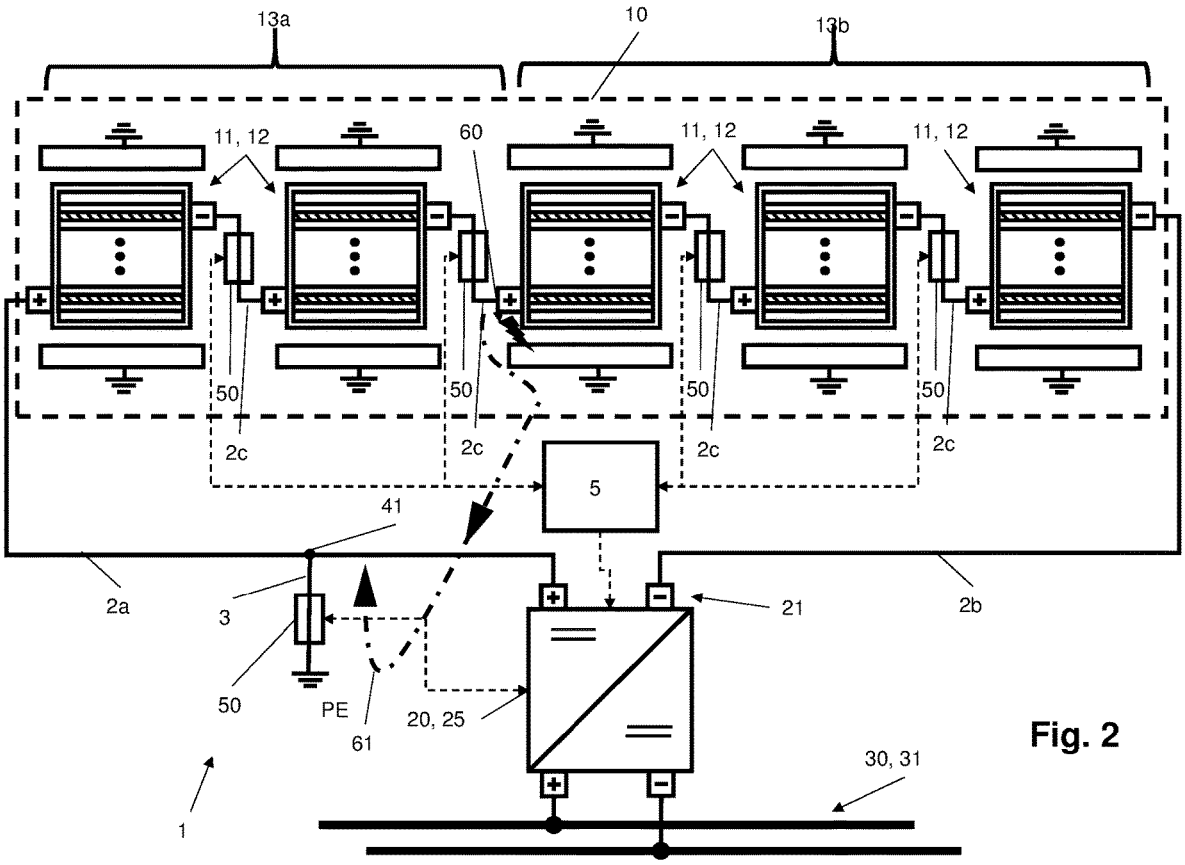
FIG. 2 illustrates a second embodiment of an electrolysis system according to the present disclosure.

FIG. 2 illustrates a second embodiment of an electrolysis system 1 according to the present disclosure. The second embodiment in many features is similar to the electrolysis system shown in FIG. 1. Therefore, with regard to identical features it is referred to the description of FIG. 1 provided above. In the following, mainly the differences between the second embodiment system 1 and in the first embodiment are described.

In contrast to FIG. 1, the electrolysis system 1 in FIG. 2 is connected via its conversion device 20 to grid 30 that is formed by a DC grid 31. Consequently, the conversion device 20 is formed as a DC/DC converter 25, for example, a bidirectional DC/DC converter 25. The conscious grounding electrolysis system 1 is provided via a grounding line 3 at a connection point 41 at the positive DC-line 2*a*. One of the at least one overcurrent protections 50 is provided in series to the grounding line 3 between the connection. 41 and ground PE. In addition, a single one of the at least one overcurrent protection circuit 50 is provided in series to each associated intermediate power line 2*c* connecting two adjacent electrolysis stacks 12, and thus connecting two adjacent electrolysis cells 11 of the series connection of electrolysis cells 11.

During the normal-operating-mode NOM the electrolysis system 1 is supplied by an electric power from the DC grid 31, that is converted by the DC/DC converter 25, wherein the converted DC-power is delivered to the electrolyzer 10. If, in addition to the conscious grounding, a ground fault 60 occurs at this series connection of electrolysis stacks 12 (and thus at this series connection of electrolysis cells 11) the series connection is divided into multiple (here exemplarily two) sub-strings 13*a*, 13*b*. In FIG. 2 the short circuited first sub-string 13*a* is connected to the consciously grounded positive terminal of the DC-output 21 and comprises the two electrolysis stacks 12 shown on the left side of FIG. 2. The respective electrolysis stacks 12 in the first sub-string 13*a* therefore start to discharge along the current path 61, that emerges due to the ground fault 60. The series connection of the remaining electrolysis stacks 12*b* form the second sub-string 13*b* and are connected on one of its sides to the negative DC-line 2*b*. They are each exposed to an overvoltage, since the total voltage of the DC-output 21, that prior to the ground fault 60 was applied to the series connection of all (here 5) electrolysis stacks, after the ground fault 60 is applied to a reduced number (here 2) of electrolysis stacks 12 connected in series.

The fault current generated by the discharge of the electrolysis stacks 12 in the first sub-string 13*a* not only flows through the overcurrent protection circuits 50 associated with an intermediate power line 2*c* in the first sub-string 13*a*, but also through the particular overcurrent protection circuit 50 arranged in series to the grounding line 3. In one embodiment, that particular overcurrent protection 50 in the grounding line 3 comprises a lower tripping level than each of the other overcurrent protection circuits 50 in the intermediate power lines 2*c*, such that the overcurrent protection circuit in the grounding line trips prior to a tripping of the other overcurrent protection circuits 50.

After the tripping of the overcurrent protection circuit 50 associated to the grounding line 3, not only the respective fault current in the first sub-string 13*a*, but also the other fault current associated with the overvoltage of the electrolysis stacks 12 within the second sub-string 13*b* is interrupted. That is due to the fact that the conscious grounding of the electrolysis system 1 is interrupted by the tripping of the overcurrent protection at the grounding line 3 and the electrolysis system 1 then again is grounded via only one ground connection that—after interruption of the conscious grounding—then is represented by the ground fault 60. Although, the grounding is at another location than previously (i.e. the conscious grounding), a stop of the electrolysis reaction in the fault-operating mode FOM is not absolutely necessary in this embodiment. Moreover, the electrolysis system 1 may be further operated to perform its electrolysis reaction also during the fault-operating-mode FOM. However, the transfer to the fault-operating-mode FOM and/or the operation within the fault-operating-mode FOM can be forwarded to an operator or a service personal of the electrolysis system 1.

Figure 3:
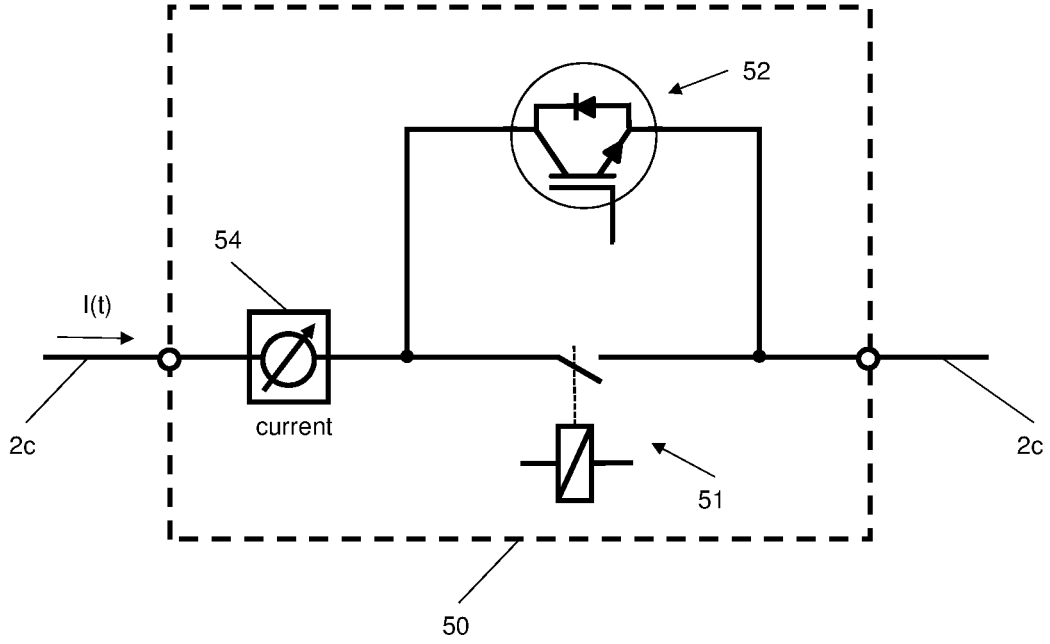
FIG. 3 illustrates an embodiment for an overcurrent protection that can be used in each of the electrolysis system of FIG. 1 or FIG. 2.

FIG. 3 shows one embodiment of an overcurrent protection circuit 50 that can be used in an electrolysis system 1 as shown in FIG. 1 or FIG. 2. The overcurrent protection circuit 50 is configured as an electronic fuse that is connected in series to an intermediate power line 2*c* and comprises a current sensor 54, an electromechanical switch 51 and a semiconductor switch 52. The semiconductor switch is connected in parallel to the electromechanical switch 51, wherein the parallel connection of both switches 51, 52 is connected in series to the current sensor 54. The overcurrent protection can comprise a separate control circuit unit (not shown in FIG. 3) for controlling the electrochemical switch 51 and the semiconductor switch. Alternatively, it is also possible that the switches 52, 51 are controlled by the control circuit 5 of the electrolysis system 1.

During the normal-operating-mode NOM of the electrolysis system 1 the electromechanical switch 51 is closed in order to provide a low impedance current path for its associated intermediate power line 2*c*. The current sensor 54 detects a current I(t) flowing in the intermediate power line 2*c* and sends that current to the control circuit, i.e. either the separate control circuit or the control circuit 5 of the electrolysis system 1. The detected current I(t) is then compared to a threshold value ITH. If the current is smaller than the threshold value, the electromechanical switch 51 is kept closed. If, however, the detected current I(t) is equal to or exceeds the threshold value the control circuit initiates a tripping of the overcurrent protection circuit 50.

For tripping, in one embodiment, at first the semiconductor switch 52 is closed if it is not already closed. Then the electromechanical switch 51 is opened and the current I(t) commutates to the semiconductor switch 52. Then the semiconductor switch 52 is opened, whereby the current I(t) is interrupted. The control circuit can also be configured to control a closing of a tripped fuse. The tripped fuse comprises an opened semiconductor switch and an opened electromechanical switch. When a closing is desired, the control circuit at first controls the opened semiconductor switch to close in order to provide a low impedance path for the intermediate power line 2*c*. After closing of the semiconductor switch the control circuit controls the opened electromechanical switch 51 to close. As a result, a current that flows in the intermediate power line 2*c* across the semiconductor switch 51 commutates to the electromechanical switch 51 due to its lower impedance. When operating in the normal operating mode the semiconductor switch 51 can be controlled to be open. However, that is not necessarily needed and it is also possible for the semiconductor switch to be closed during the normal-operating-mode NOM.

As explained above, the overcurrent protection 50 that is configured as an electronic fuse is controlled based on a signal from the current sensor 54. In an alternative embodiment it is also possible that the overcurrent protection 50 configured as an electronic fuse can be controlled based on a voltage value that is related to its respective intermediate power line 2*c*. For each of the intermediate power lines 2*c* these voltage values, e.g. can be detected by a fault localization circuit or device 70 shown in FIG. 4*a* or FIG. 4*b*. For example, as explained in combination with FIG. 4*a* and FIG. 4*b*, the fault localization circuit 70 is configured to detect an occurrence and also a location of the ground fault 60. In response to a detected ground fault 60, the occurrence and the location of the ground fault 60 are signaled to the control circuit 5 of the electrolysis system 1 which then initiates a tripping of one or more of the overcurrent protections 50 in order to transfer the electrolysis system 1 from its normal-operating-mode NOM to its fault-operating-mode FOM.

Figure 4A:
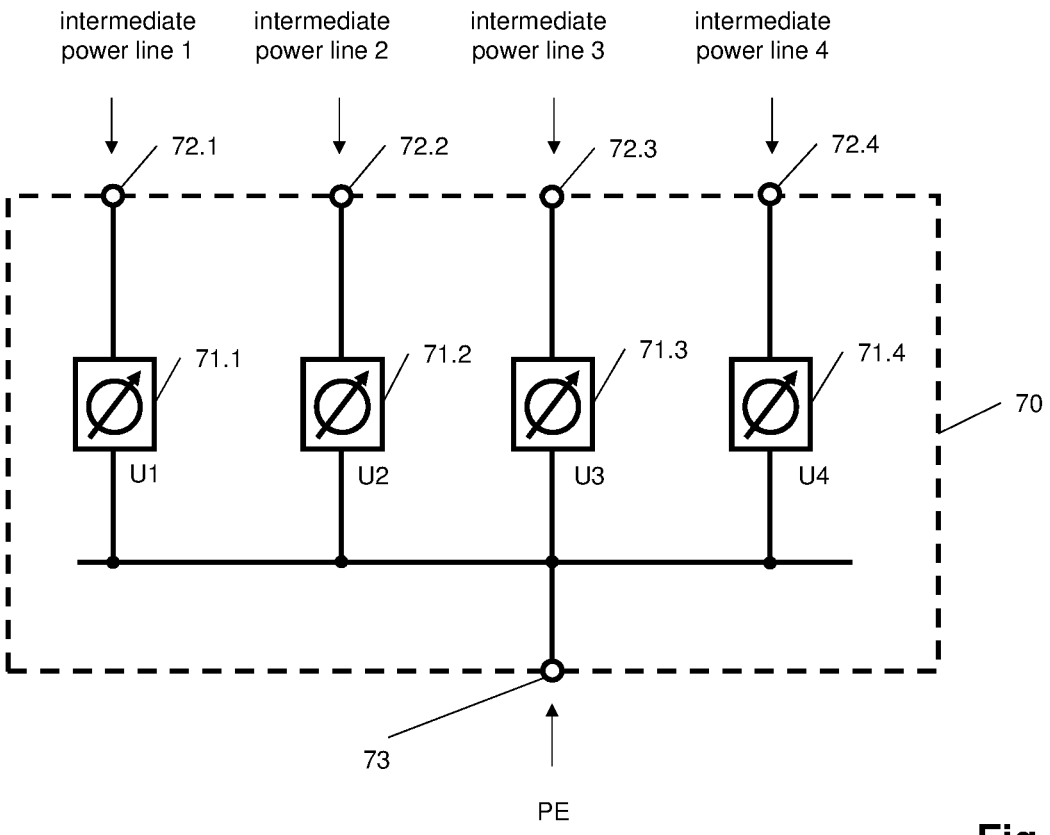
FIG. 4*a* illustrates a first embodiment of a fault localization means useable for an electrolysis system as shown in FIG. 1 or FIG. 2.

In FIG. 4*a* a first embodiment of a fault localization circuit 70 is illustrated, that can be used in an electrolysis system 1 as shown in FIG. 1 or FIG. 2. The fault localization circuit 70 operates based on voltage measurements conducted at multiple ones of the intermediate power lines 2*c* associated with the electrolysis system 1 and, therefore, comprises a plurality of input connections 72.1-72.4, each configured to connect to a different one of multiple intermediate power lines 2*c* of the electrolysis system 1. In addition, the fault localization circuit comprises a ground connection terminal 73 configured to connect to the ground potential PE of the electrolysis system 1.

During operation of the electrolysis system 1, i.e. during its normal-operating-mode NOM and also during its FOM mode, voltages present between each of the intermediate power lines 2*c* connected to the fault localization circuit and in each case ground potential PE are detected by respective voltage sensors 71.1-71.4. During the normal-operation-mode NOM the voltages are dependent on the number of electrolysis cells between two adjacent intermediate lines 2*c* that are measured, the total number of electrolysis cells 11 in the series connection of electrolysis cells of the electrolyzer, and the voltage at the DC-output.

If a ground fault 60 occurs at a particular location in the electrolysis system 1, each voltage sensor 71.1-71.4 connected to an intermediate power line 2*c* that is localized in the short-circuited first sub-string 13*a* of the series connection of electrolysis cells 11, indicates a voltage value close to 0V or 0V, whereas the other voltage sensors, that are comprised by the second sub-string 13*b*—or, if existing, the third sub-string 13*c*—indicate larger absolute voltage values U1-U4 than they have shown during the normal-operating-mode NOM of the electrolysis system 1, for example, immediately before the occurrence of the ground fault 60.

Figure 4B:
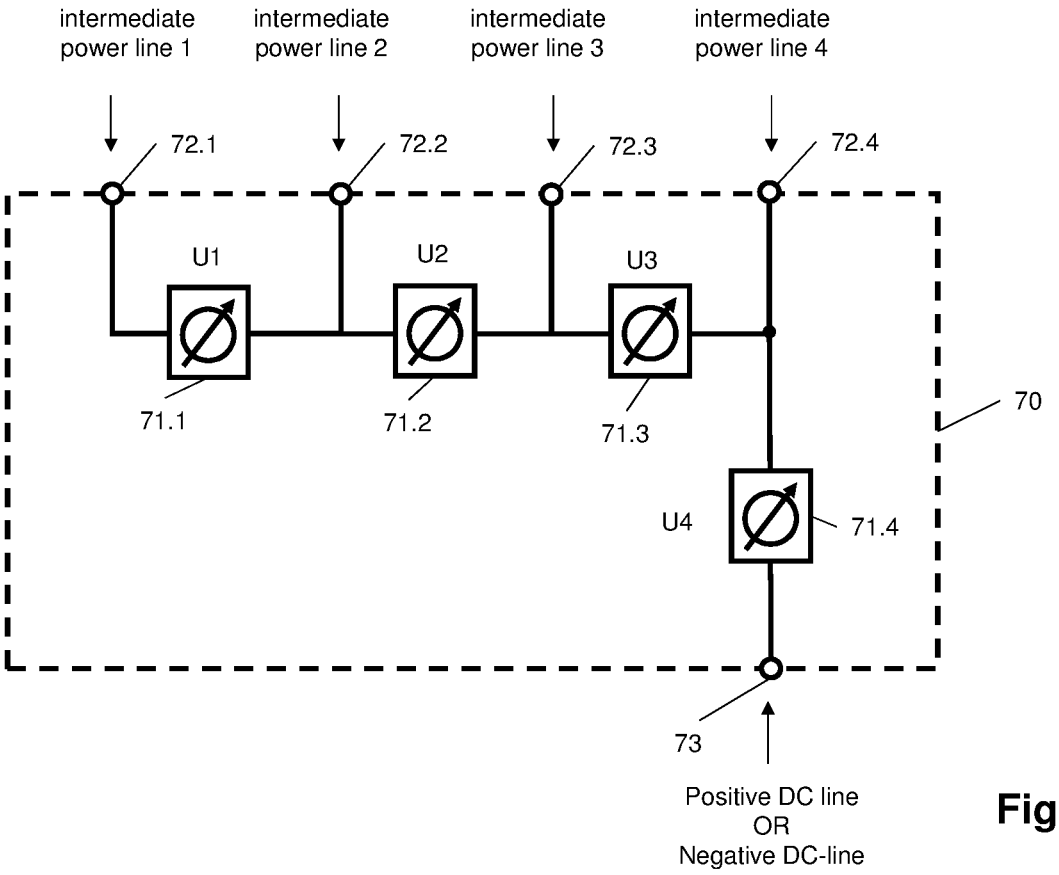
FIG. 4*b* illustrates a second embodiment of a fault localization means useable for an electrolysis system as shown in FIG. 1 or FIG. 2.

In FIG. 4*b* a second embodiment of a fault localization circuit or device 70 is illustrated that also operates by voltage measurements conducted at the intermediate power lines 2*c* of the series connection of electrolysis cells 11. However, instead of detecting the voltages between each intermediate power line 2*c* and ground potential PE—as shown in FIG. 4*a*—in FIG. 4*b* voltages that are present between a respective intermediate power line 2*c* and one of its adjacent intermediate power lines 2*c* are detected for each intermediate power line 2*c*, wherein for one outer intermediate power line 2*c* (here intermediate power line 4) a voltage between that outer intermediate power line 2*c* and the positive DC-line or the negative DC-line is measured. Therefore, the voltage sensors 71.1-71.3 are connected between adjacent ones of the respective input connections 72.1-72.4 and the voltage sensor 71.4 is connected between the outer input connection 72.4 and the positive DC-line 2*a* or the negative DC-line 2*b*. Also, this second embodiment enables one to localize the ground fault 60 by comparing the measured voltages U1-U4 taken during the fault-operating-mode FOM or during the transfer to the fault operating-mode FOM with the respective voltages U1-U4 taken during the normal-operating-mode NOM immediately before the ground fault.

With both embodiments of the fault localization circuit it is not only possible to localize the ground fault 60, but also to indicate the occurrence of the ground fault 60 by respective changes in the detected voltage values U1-U4. Therefore, the fault localization circuit 70 can also be used to signal to the control circuit 5 if the electrolysis system 1 operates in the normal-operating-mode NOM or if a ground fault 60 has occurred in the electrolysis system that requires a transfer to the fault-operating-mode FOM and/or, consequently, an operation in the fault-operating-mode FOM.

What is claimed is:

1. An electrolysis system comprising:

an electrolyzer; and a conversion device configured to supply power to the electrolyzer out of a grid, wherein the electrolyzer comprises a plurality of electrolysis cells connected in series to each other and wherein the series connection of electrolysis cells is connected through a positive DC-line and through a negative DC-line to a DC-output of the conversion device, wherein a conscious grounding of the series connection is provided via a grounding line at a connection point of the positive DC-line, at a connection point of the negative DC-line or at a connection point of an intermediate power line between two adjacent electrolysis cells, and at least one overcurrent protection circuit, wherein each of the at least one overcurrent protection circuit is:

i.) arranged between two respective adjacent electrolysis cells of the series connection of electrolysis cells and connected in series with an intermediate power line connecting the two adjacent electrolysis cells of the series connection of electrolysis cells, and/or ii.) arranged in series with a respective grounding line between its respective connection point and ground (PE), wherein one or more of the at least one overcurrent protection circuit receives a ground fault trip signal from a control circuit or a current sensor, and is configured to trip when the ground fault trip signal indicates an overcurrent condition when a ground fault is occurring at the series connection of electrolysis cells, or wherein the at least one overcurrent protection circuit comprises a melt fuse and trips when a predetermined energy level associated with an overcurrent condition is achieved, thereby preventing an application of a damaging overcurrent and/or a damaging overvoltage to the electrolysis cells.

2. The electrolysis system according to claim 1, wherein the grid is a DC grid and the conversion device is configured as a DC/DC-converter.

3. The electrolysis system according to claim 1, wherein the grid is an AC grid and the conversion device is configured as an AC/DC-converter.

4. The electrolysis system according to claim 3, wherein the AC/DC-converter is configured as a multi-stage converter comprising an AC/DC-conversion circuit and a DC/DC-conversion circuit.

5. The electrolysis system according to claim 1, wherein the conversion device is a bidirectional conversion device that is configured to decrease a voltage on its DC-output by transferring an electric power from the DC-output to the grid during a transfer to a fault-operating-mode (FOM) and/or during the fault-operating-mode (FOM).

6. The electrolysis system according to claim 1, further comprising a control device that is configured to control the conversion device during a fault-operating-mode (FOM) or during a transfer to the fault-operating-mode (FOM) to stop a power conversion and/or to reduce a DC-voltage at the DC-output.

7. The electrolysis system according to claim 1, wherein the at least one overcurrent protection circuit comprises two or more overcurrent protection circuits that are each arranged at a different intermediate location within the series connection of electrolysis cells and that are each connected in series with an intermediate power line connecting two adjacent electrolysis cells of the series connection of electrolysis cells.

8. The electrolysis system according to claim 1, wherein in addition to the at least one overcurrent protection circuit in series with an intermediate power line connecting two adjacent electrolysis cells and/or in series with the grounding line between the connection point and ground (PE), the electrolysis system comprises a further overcurrent protection circuit located at a positive DC-line and/or a further overcurrent protection circuit located at a negative DC-line.

9. The electrolysis system according to claim 1, wherein one or more of the at least one overcurrent protection circuit comprises a melt-fuse or an electronic fuse.

10. The electrolysis system according to claim 1, wherein the plurality of electrolysis cells is formed by a plurality of electrolysis stacks connected in series to each other, wherein each electrolysis stack comprises a group of multiple electrolysis cells connected in series to each other, and wherein the at least one overcurrent protection circuit comprises a plurality of overcurrent protection circuits, wherein each overcurrent protection circuit out of the plurality of overcurrent protection circuits is arranged between two adjacent electrolysis stacks.

11. A method of operating an electrolysis system according to claim 1 comprising:

operating the electrolysis system in a normal-operating-mode (NOM), wherein a DC-power is supplied to the series connection of electrolysis cells by the conversion device, and in response to a ground fault occurring at the series connection of electrolysis cells, initiating a tripping of one or more of the at least one overcurrent protection circuit and transferring operation of the electrolysis system to a fault-operating-mode (FOM) during which a damaging overcurrent and/or overvoltage applied to one, or more, or each of the plurality of electrolysis cells and/or the conversion device is prevented.

12. The method according to claim 11, wherein in response to a transfer to the fault-operating-mode (FOM) and/or during the fault-operating-mode (FOM) of the electrolysis system, controlling a control circuit of the electrolysis system to control the conversion device to stop its power conversion and/or reduce its DC-output-voltage.

13. The method according to claim 11, wherein during the fault-operating-mode (FOM) of the electrolysis system controlling the control circuit to control the conversion device to at least temporarily continue its power supply to the series connection of the electrolysis cells, if one of the at least one overcurrent protection circuit arranged in series with the grounding line between the connection point and ground (PE) is tripped.

14. The method according to claim 11, wherein in response to the transfer to the fault-operating-mode (FOM) or during the fault-operating-mode (FOM), generating a signal in the electrolysis system indicating its fault-operating-mode (FOM) and/or an information about the one or more of the at least one overcurrent protection circuits that has or have been tripped.

15. The method according to claim 11, wherein during a transfer to the fault-operating-mode (FOM) and/or during the fault-operating-mode (FOM), measuring multiple voltages (U1-U5) each between an intermediate power line connecting two adjacent electrolysis cells and ground (PE), or each between two intermediate power lines for a plurality of different intermediate power lines of the series connection of electrolysis cells in order to localize the ground fault.

16. The method according to claim 12, wherein the controlling of the control circuit of the electrolysis system is performed only when one of the at least one overcurrent protection circuit arranged in series with the intermediate power line connecting adjacent electrolysis cells of the series connection of electrolysis cells is tripped.

* * * * *